US011325762B2

(12) United States Patent
Tarrant

(10) Patent No.: US 11,325,762 B2
(45) Date of Patent: May 10, 2022

(54) CONTAINER-CLOSURE SYSTEM

(71) Applicant: ELC Management LLC, Melville, NY (US)

(72) Inventor: Philip Andrew Tarrant, Glen Rock, NJ (US)

(73) Assignee: ELC Management LLC, Melville, NY (US)

( * ) Notice: Subject to any disclaimer, the term of this patent is extended or adjusted under 35 U.S.C. 154(b) by 32 days.

(21) Appl. No.: 17/021,545

(22) Filed: Sep. 15, 2020

(65) Prior Publication Data

US 2022/0081175 A1 Mar. 17, 2022

(51) Int. Cl.

*B65D 51/28* (2006.01)
*B65D 41/04* (2006.01)
*B65D 81/32* (2006.01)

(52) U.S. Cl.

CPC ..... *B65D 51/2814* (2013.01); *B65D 41/04* (2013.01); *B65D 81/3211* (2013.01); *B65D 2251/0028* (2013.01); *B65D 2251/0078* (2013.01)

(58) Field of Classification Search

CPC ..... B65D 51/2814; B65D 41/04; B65D 81/3211; B65D 81/32; B65D 81/3222; B65D 81/3227; B65D 81/3244; B65D 81/3255; B65D 2251/0028; B65D 2251/0078; B65D 23/04; B65D 25/08; B65D 25/085; B65D 25/087; B65D 35/242; B65D 83/66; B65D 83/685

USPC ..... 220/254.8; 206/222, 219

See application file for complete search history.

(56) References Cited

U.S. PATENT DOCUMENTS

| | | | | |
|---|---|---|---|---|
| 4,103,772 | A | 8/1978 | Wiegner | |
| 4,196,819 | A * | 4/1980 | Fontanaud | B65D 41/0492 215/253 |
| 5,884,759 | A | 3/1999 | Gueret | |
| 6,003,728 | A | 12/1999 | Elliott | |
| 8,087,842 | B2 | 1/2012 | Bouix et al. | |
| 10,661,968 | B1 | 5/2020 | Hilton et al. | |
| 2002/0179461 | A1* | 12/2002 | Mollstam | B65D 81/3222 206/219 |
| 2004/0079383 | A1 | 4/2004 | Wayne et al. | |
| 2011/0174642 | A1* | 7/2011 | Coon | B65D 51/2835 215/228 |

(Continued)

FOREIGN PATENT DOCUMENTS

| | | |
|---|---|---|
| CN | 207270060 | 4/2018 |
| CN | 109383923 | 2/2019 |

(Continued)

OTHER PUBLICATIONS

U.S. Appl. No. 17/021,483, filed Sep. 15, 2020, Philip Andrew Tarrant.

(Continued)

*Primary Examiner* — Robert Poon
(74) *Attorney, Agent, or Firm* — Peter Giancana

(57) ABSTRACT

A container-closure system comprises a threaded-neck container that houses a first flowable product in a first reservoir. A closure assembly for the container initially houses a second flowable product in a second reservoir, and comprises a threaded cap and a cap insert. Movement of the cap insert with respect to the threaded cap effects the mixing of the two flowable products in the first reservoir.

8 Claims, 15 Drawing Sheets

(56) References Cited

U.S. PATENT DOCUMENTS

| | | | | |
|---|---|---|---|---|
| 2017/0152080 | A1* | 6/2017 | Zoppas | B65D 47/061 |
| 2017/0253412 | A1 | 9/2017 | Mühlemann | |
| 2018/0009590 | A1* | 1/2018 | Wong | B65D 1/0246 |
| 2020/0156851 | A1 | 5/2020 | Bidament et al. | |

FOREIGN PATENT DOCUMENTS

| | | | |
|---|---|---|---|
| JP | 2020083451 | | 6/2020 |
| KR | 2002861350000 | B1 | 8/2002 |
| KR | 10-1516372 | | 5/2015 |
| WO | WO-2016-099130 | A1 | 6/2016 |
| WO | WO-2018/118845 | A1 | 6/2018 |

OTHER PUBLICATIONS

PCT International Search Report; International Application No. PCT/US2021/050346; Completion Date: Dec. 28, 2021; dated Dec. 29, 2021; 20.57.

PCT Written Opinion of the International Searching Authority; International Application No. PCT/US2021/053046; Completion Date: Dec. 28, 2021; dated Dec. 29, 2021; 20.57.

* cited by examiner

CONTAINER-CLOSURE SYSTEM

FIELD OF THE INVENTION

The invention is in the field of packaging for consumer products, such as found in the cosmetic and personal care industry. More specifically, the invention pertains to packaging that is able to keep multiple ingredients and/or compositions separated until they are mixed at the time of use.

BACKGROUND

One of the problems that formulators sometimes face is the use of ingredients whose efficacy or potency decreases with time. Thus, the time from filling a container until the first use by the consumer, represents a loss of efficacy or potency. To compensate for this, a formulator may include more of the ingredient than is really needed by the consumer. For example, a particular enzyme may slowly breakdown in the composition. To ensure that there is an efficacious amount of the enzyme by the time the consumer uses the product, extra enzyme may be put into the composition. This is an obvious disadvantage, as the enzyme may be expensive or the degraded enzyme may further disturb the chemical composition. Thus, it would be advantageous if the enzyme could be protected from degradation until the time of first use by the consumer. Furthermore, a formulator may wish to include in the composition, one or more ingredients that are reactive with the composition for some beneficial purpose. However, in some situations, it may be advantageous to delay that reaction until the time of first use by a consumer. That is not possible with a conventional, single compartment container.

In the cosmetic and personal care industry, packaging that is able to keep multiple ingredients and/or compositions separated are known. For example, U.S. Pat. No. 8,087,842 discloses a multi-compartment, wiper-applicator package that comprises a container holding a first formulation, a wiper that is initially sealed at both ends, and a barbed tool. Within the sealed wiper is a quantity of secondary ingredients that is to be mixed with the first formulation in the container. The barbed tool is able to pierce the top seal, and then dislocate the bottom seal to allow the secondary ingredients to fall into the first formulation for mixing therewith.

WO2018/118845 discloses a fresh composition delivery system includes a package with two compartments separated by a foil seal for separating a cosmetically acceptable carrier from an unstable active ingredient. At the bottom of a container, an elastomeric bulb with a dart can be actuated by the user to pierce the foil seal so that the carrier and the active can be mixed in the package to form a composition shortly before use.

U.S. Pat. No. 10,661,968 discloses a container system for mixing and dispensing that comprises two containers, each container holding one or more ingredients. A first container is sealed with a foil seal. A second container is sealed with a reusable cap and closure. At the time of use, the containers are able to be joined in a way that creates a passageway from one container to the other, which allows the ingredients in each container to mix. When the containers are separated, the first container is empty, and the second container holds the mixed ingredients. The second container can be fitted with the reusable cap closure to seal off the mixed ingredients from the ambient environment.

OBJECT OF THE INVENTION

To provide a single container and single closure system that is able to prevent multiple ingredients and/or compositions from mixing until the time of first use, while being very easy to use.

SUMMARY

A container-closure system according to the present invention comprises an ordinary threaded-neck container that houses a first flowable product. A threaded closure assembly for the container initially houses a second flowable product. The closure assembly comprises a threaded cap, a cap insert and a piercing means. Movement of the cap insert with respect to the threaded cap effects the mixing of the two flowable products in the container.

DETAILED DESCRIPTION

The term "comprises" and its variants means that a list of elements is not necessarily limited to those explicitly recited.

Figure 1:
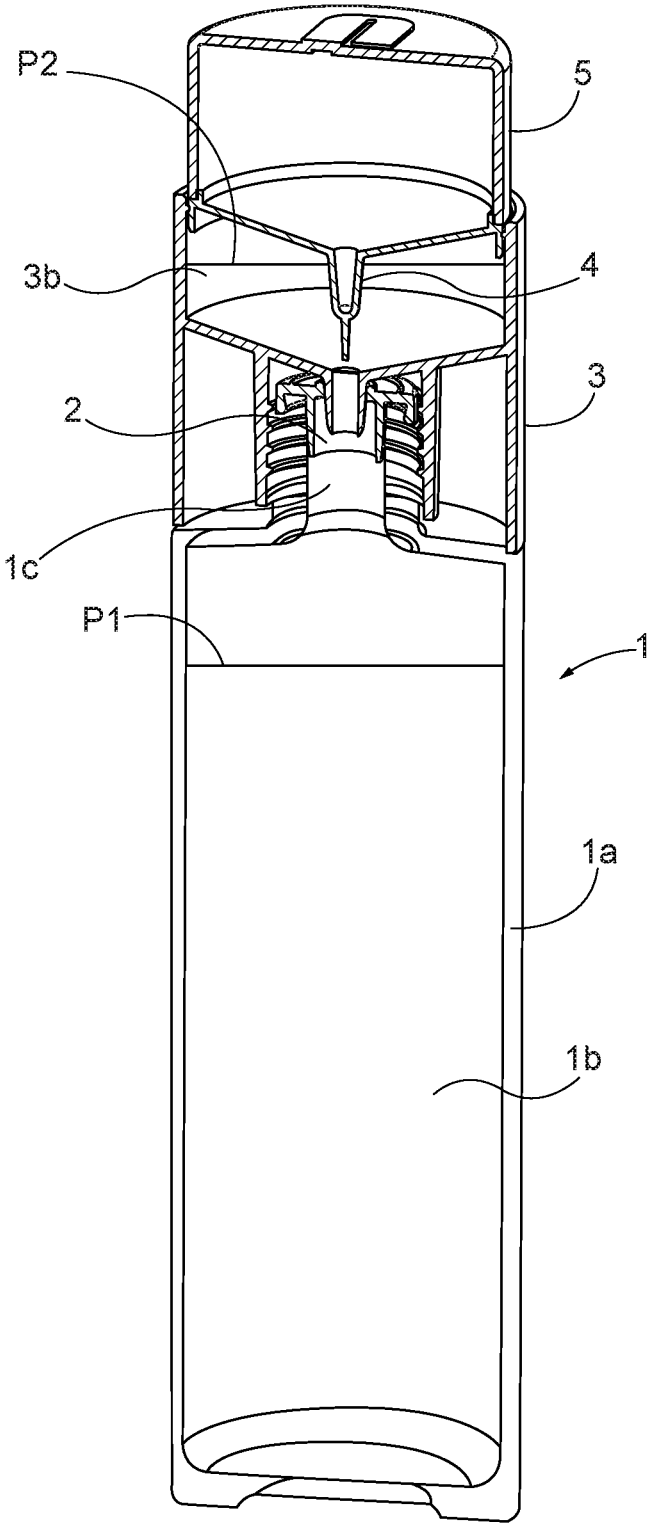
FIG. 1 is a cross section of a container-closure system according to the invention.
Figure 2:
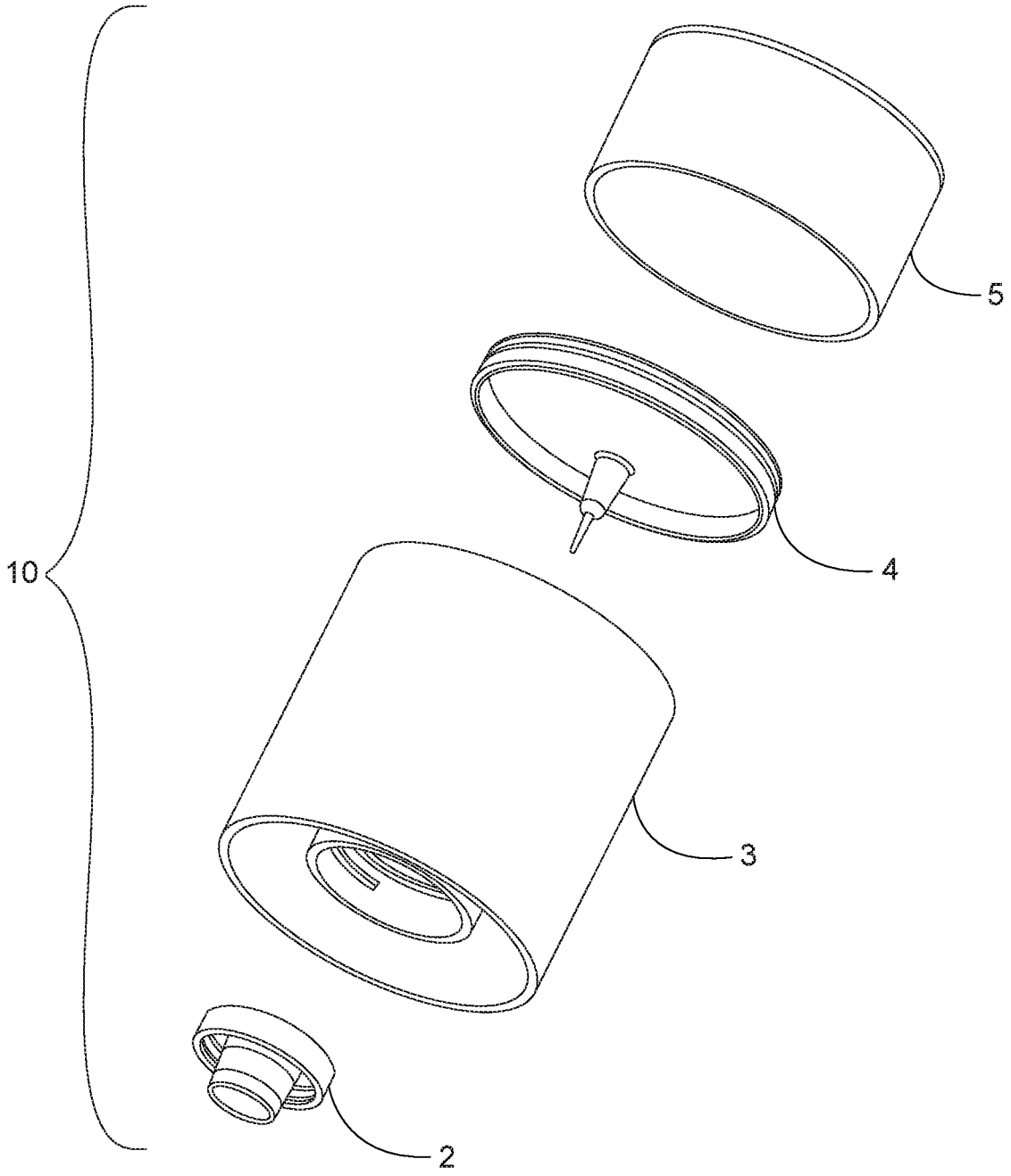
FIG. 2 is an exploded view of a closure assembly according to the invention.

The present invention maintains two products separately until the time of first use. The term "product" may refer to a composition comprising a multiplicity of ingredients, or it may refer to a single ingredient. For example, it may be desirable to maintain an active ingredient separate from the main composition until just prior to first use, in order to preserve the activity of the ingredient. Various types of personal care products may find use with the present invention. However, before mixing, at least one of the products should be flowable, and after mixing, the combined products should also be flowable. For example, either product may be a readily flowable liquid or flowable granulated solid (such as a powder). It is not a requirement that the products possess any degree of mutual solubility, however, it is preferable if one product is at least partially soluble in the other, and more preferable if the two products can achieve complete miscibility with simple shaking. Referring to FIGS. 1 and 2, a container-closure system according to the present invention comprises a container (1), an orifice reducer (2), an threaded cap (3), a piercing means (4), and a cap insert (5). FIG. 1 shows these components in their initial relationship to one another.

Figure 3:
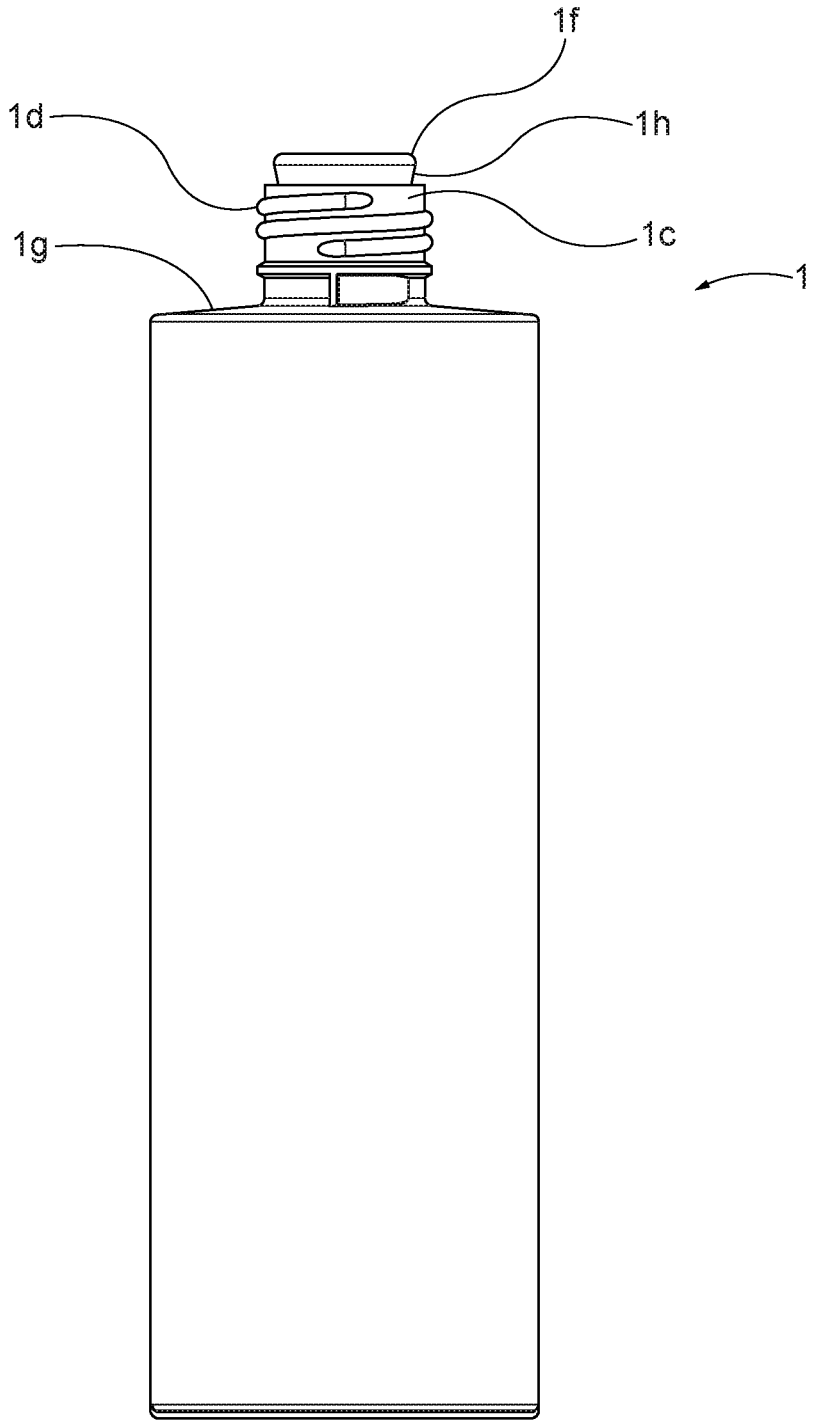
FIG. 3 is an elevation view of a container useful in the present invention.

A container useful in the present invention may be an ordinary threaded-neck container of the type typically used in consumer goods packaging, such as that shown in FIGS. 1 and 3. For example, the container (1) comprises a wall (1*a*) that defines a first reservoir (1*b*) that is able to house a first flowable product (P1). The first flowable product flows into and out of the first reservoir through a neck (1*c*) of the container. The outer surface of the neck comprises screw threads (1*d*) for attaching the threaded cap (3). Below the threads, the container is formed with a shoulder (1*g*). Above the threads, the top surface (1*f*) of the neck may be formed with a groove (1*h*). Typically, the container may be glass or plastic.

Figure 4:
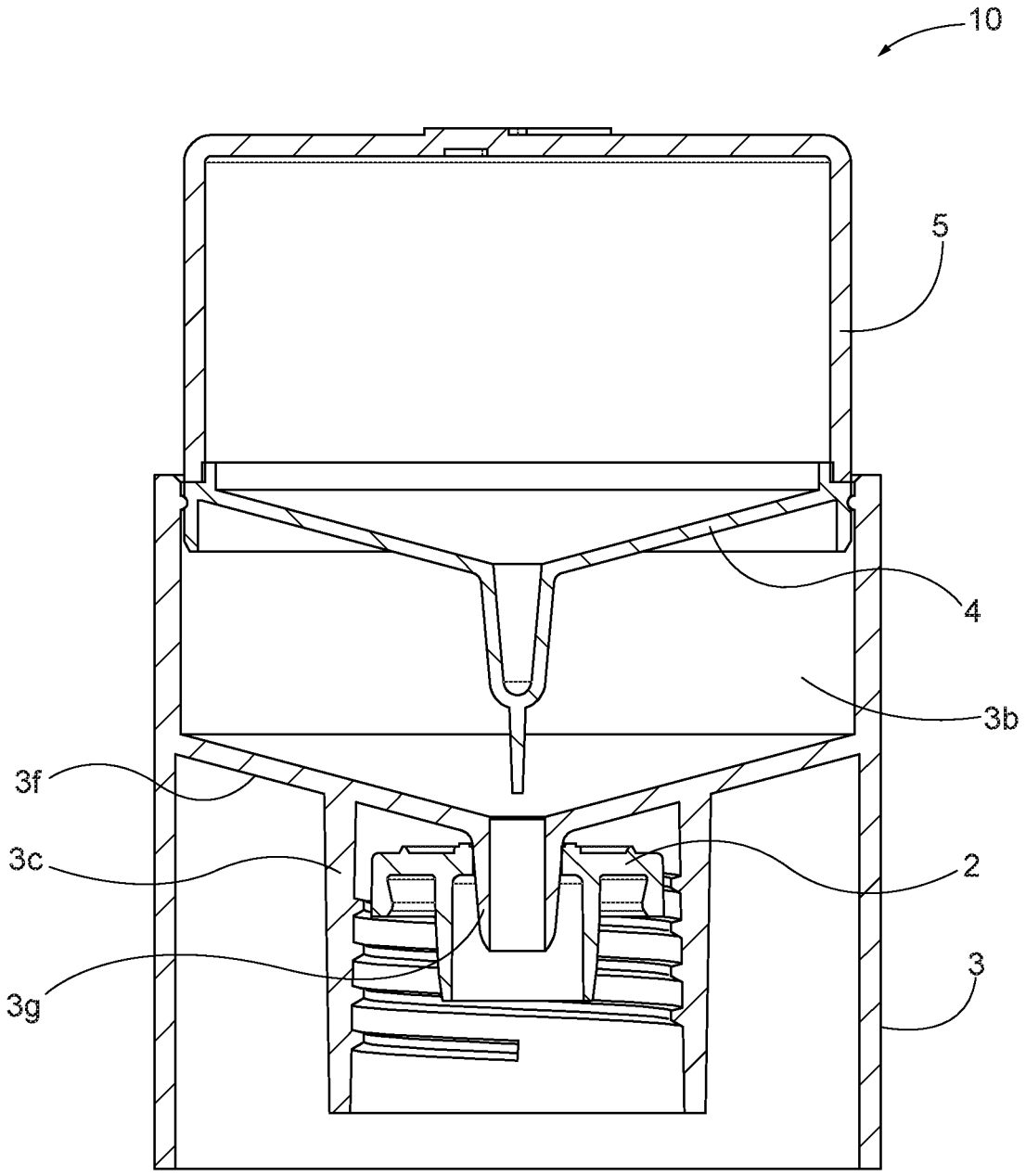
FIG. 4 is a cross sectional view of a closure assembly according to the invention.
Figure 5:
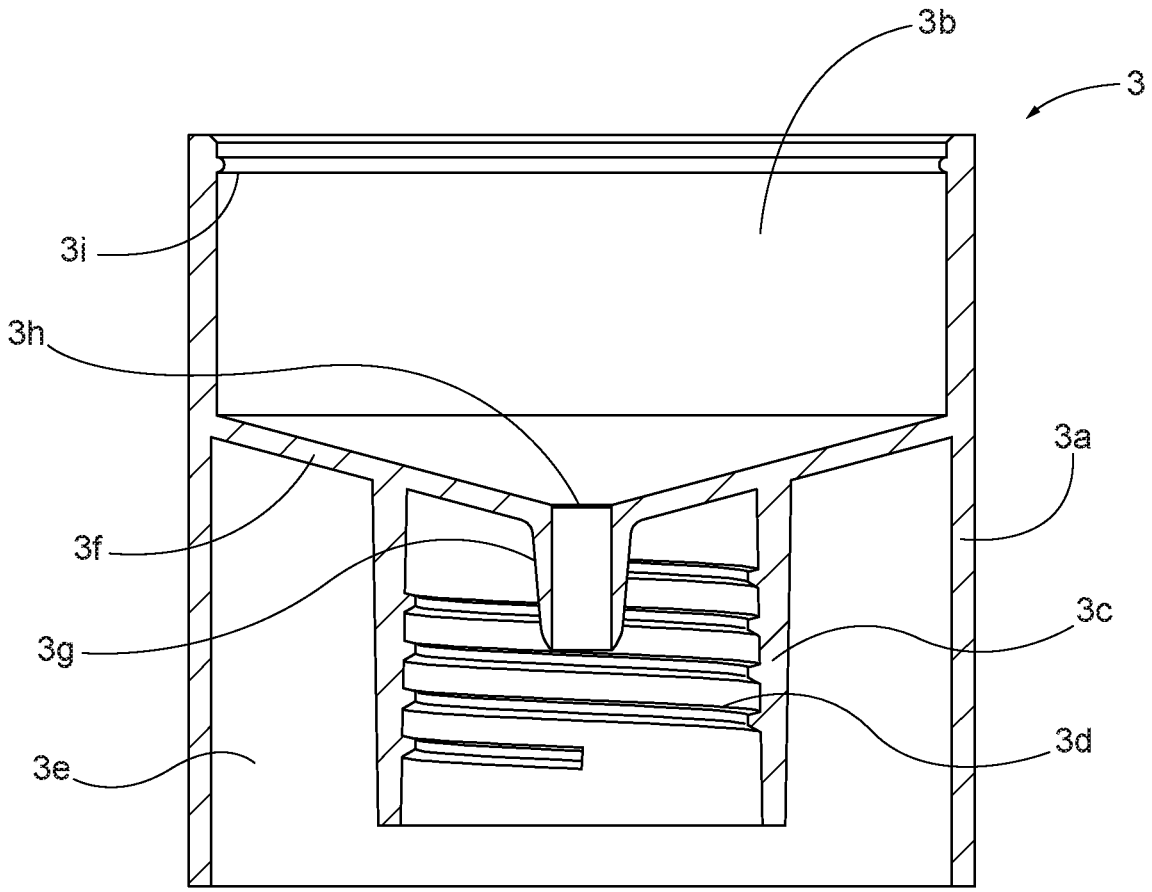
FIG. 5 is a cross sectional view of a threaded cap according to the invention.
Figure 6:
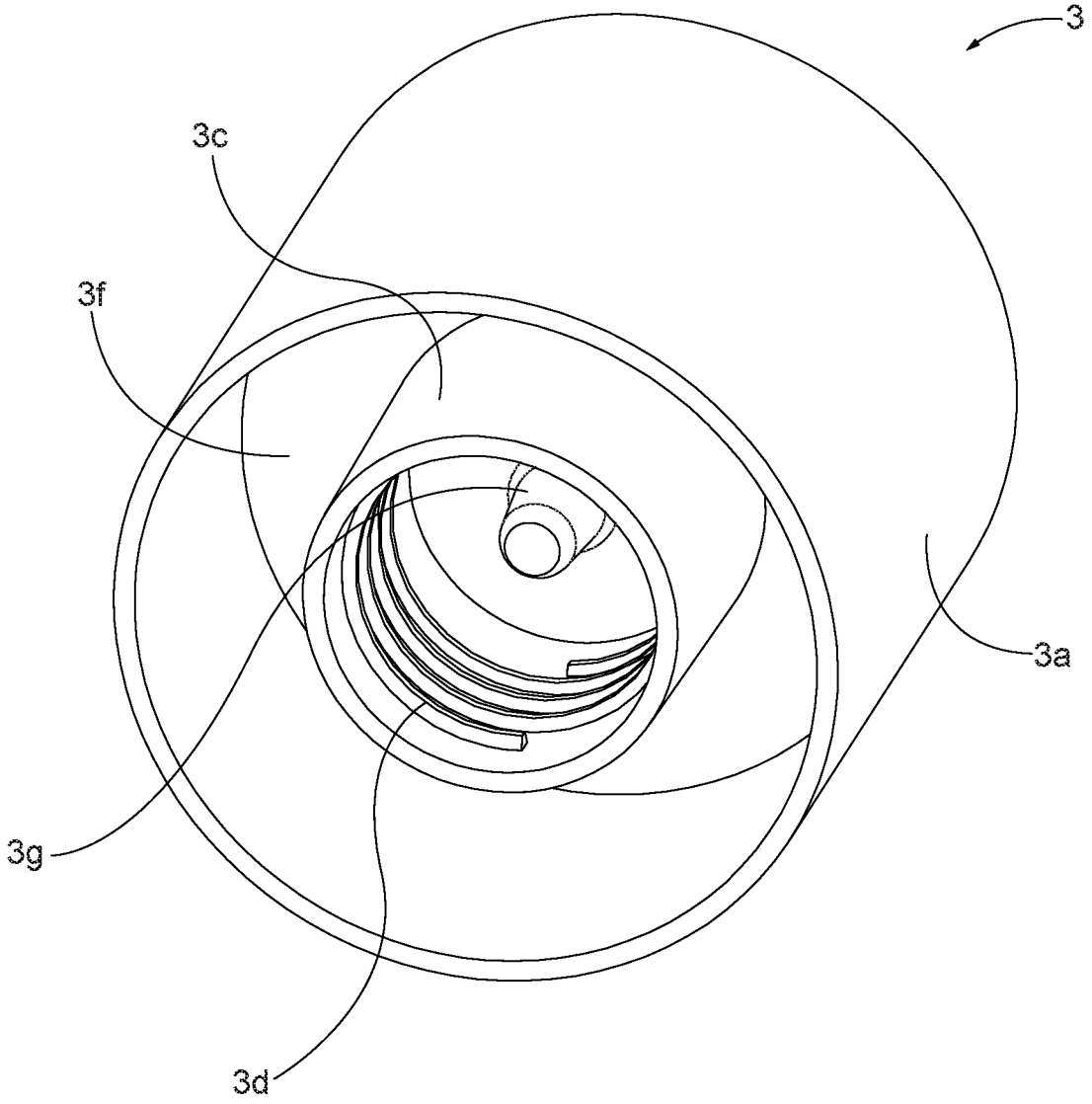
FIG. 6 is a perspective view of a threaded cap according to the invention.

The closure assembly (10) of the present invention may be ordinary in external appearance. However, as shown in FIGS. 2 and 4, the closure assembly (10) that we describe comprises an orifice reducer (2), a threaded cap (3), a piercing means (4) and a cap insert (5), wherein the cap insert and piercing means are able to move as one, inside to the threaded cap. Referring to FIGS. 5 and 6, the threaded cap (3) comprises a vertical wall (3*a*) that defines an interior space. A transverse partition (3*f*) divides the interior space into an upper section (3*b*) and a lower section (3*e*). The upper section (3*b*) has an opened top that is able to receive the piercing means and cap insert. The upper section also functions as a second reservoir that is able to house a second flowable product (P2). Depending from the transverse partition (3*f*), down into the lower section, is a collar (3*c*). The collar comprises screw threads (3*d*) that are able to cooperate with the threads (1*d*) of the container (1). Also depending from the transverse partition (3*f*) is a hollow stem (3*g*) that is located inside the collar, and is concentric with the collar. The hollow stem is sealed along some portion of the hollow stem with a breakable seal. For example, the top end of the hollow stem may be sealed with a frangible membrane (3*h*), such as foil. When the breakable seal is in tact, it forms a liquid tight seal, and prevents the flow of the second flowable product (P2) through the hollow stem (3*g*). Optionally, a circumferential bead (3*i*) is located on the inner surface of the vertical wall (3*a*), above the transverse partition (3*f*), close to the top of the threaded cap.

Figure 7:
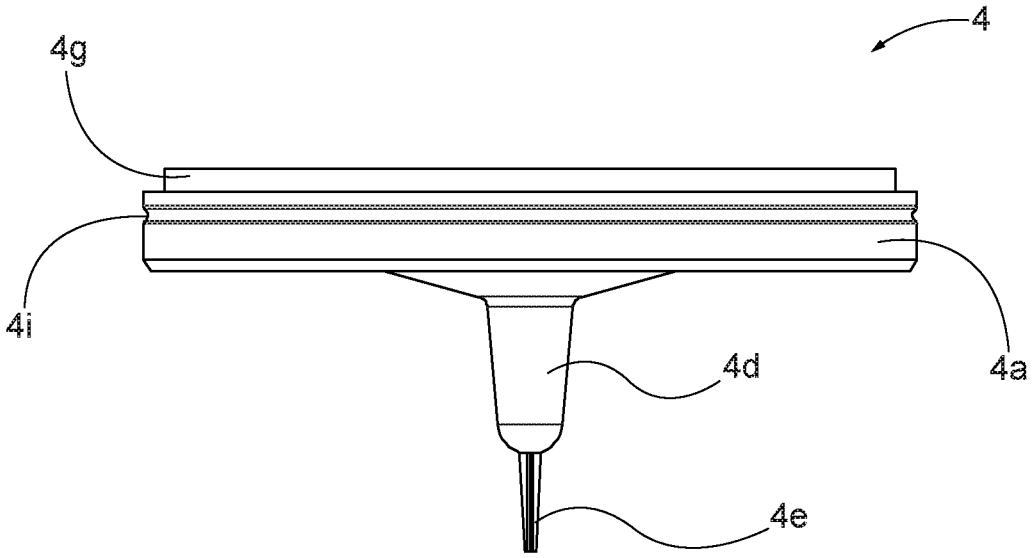
FIG. 7 is an elevation view of a piercing means.
Figure 8:
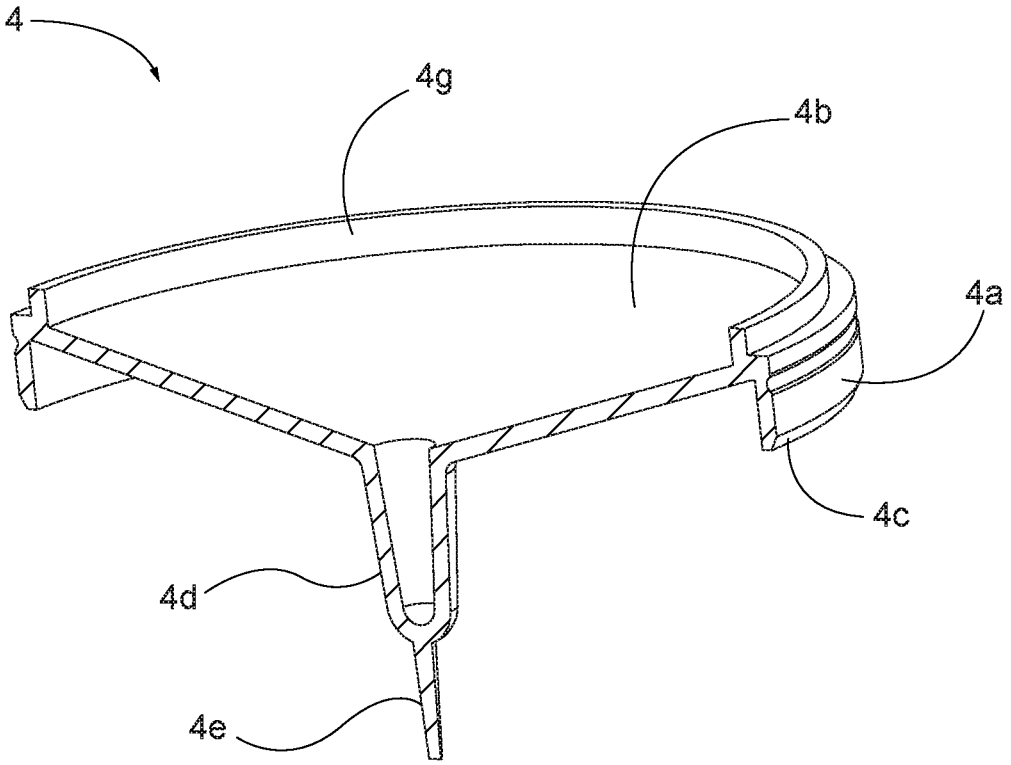
FIG. 8 is a cross sectional view of the piercing means of FIG. 7.

The piercing means (4) is depicted in FIGS. 7 and 8. The piercing means comprises a cylindrical side wall (4*a*), a closed top (4*b*) and an opened bottom (4*c*). Depending downward from the center of the closed top is a pintel (4*d*). The pintel is sized to effect a liquid-tight seal whenever it is inserted into the hollow stem (3*g*) of the threaded cap (3). Optionally, the distal end of the pintel may be formed as a sharp point (4*e*). Rising from the closed top of the piercing means is a circumferential knee wall (4*g*).

Figure 9:
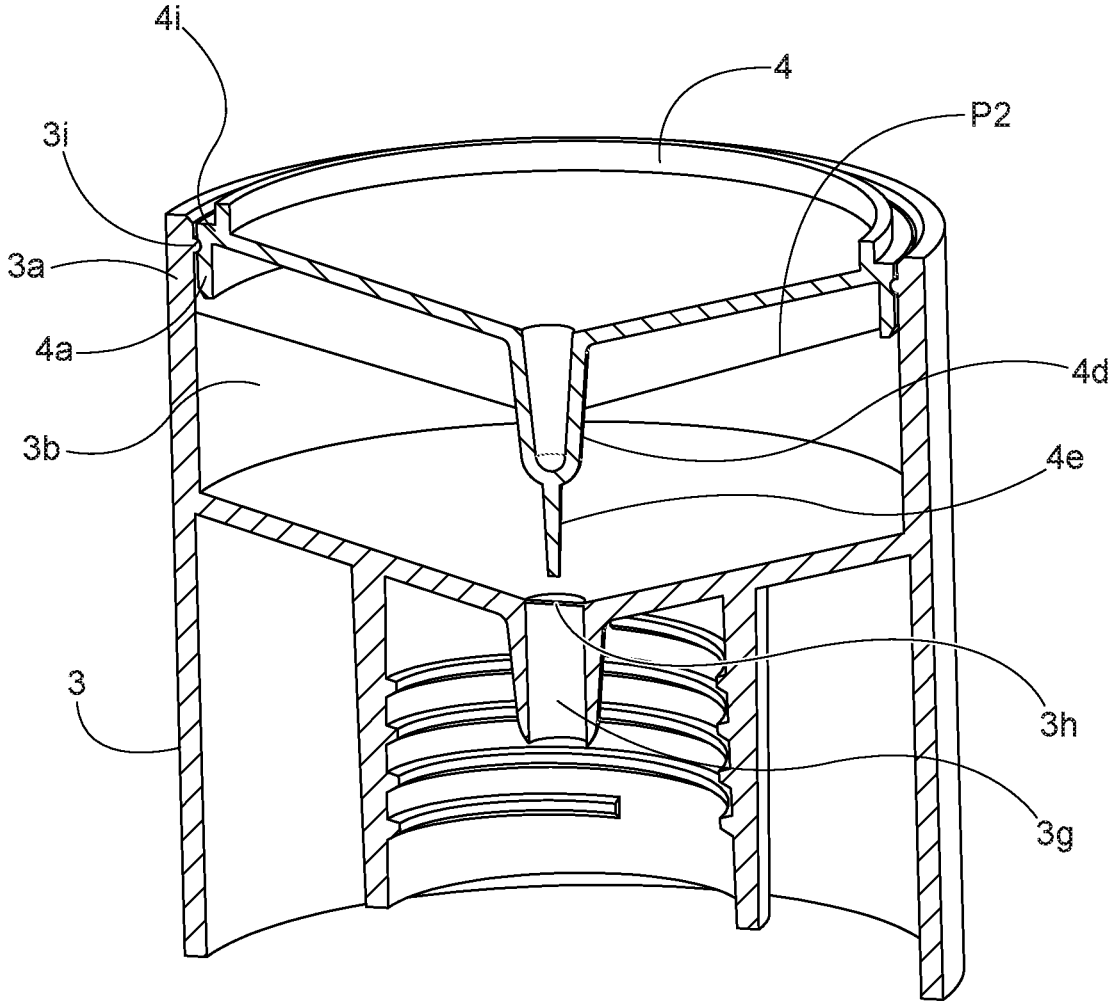
FIG. 9 shows the piercing means in its initial relationship to the threaded cap.

Referring to FIG. 9, the cylindrical side wall (4*a*) of the piercing means (4) is designed to fit snugly, but slidably, into the upper section (3*b*) of the threaded cap (3). The fit of the cylindrical sidewall (4*a*) of the piercing means against the vertical wall (3*a*) of the threaded cap is sufficient to effect a liquid tight seal therebetween, even when the piercing means is sliding within the threaded cap. The piercing means has an initial upper position with respect to the threaded cap. In its upper position, the piercing means sits near the top of the vertical wall (3*a*) of the threaded cap. To further define the upper position, the outer surface of the cylindrical side wall of the piercing means may have a circumferential groove (4*i*) for receiving the circumferential bead (3*i*) of the threaded cap, and forming a liquid tight seal therebetween. When the piercing means and threaded cap are in their initial upper position, then the distal end (4*e*) of the pintel (4*d*) does not extend as far as the breakable seal (3*h*) of the hollow stem (3*g*). In this way, the second flowable product (P2) is trapped in the second reservoir (3*b*) of the threaded cap, and not allowed to fall into the first reservoir (1*b*) of the container (1). The piercing means also has a final lower position with respect to the threaded cap. This final lower position is reached when the piercing means cannot be lowered any further.

Figure 10:
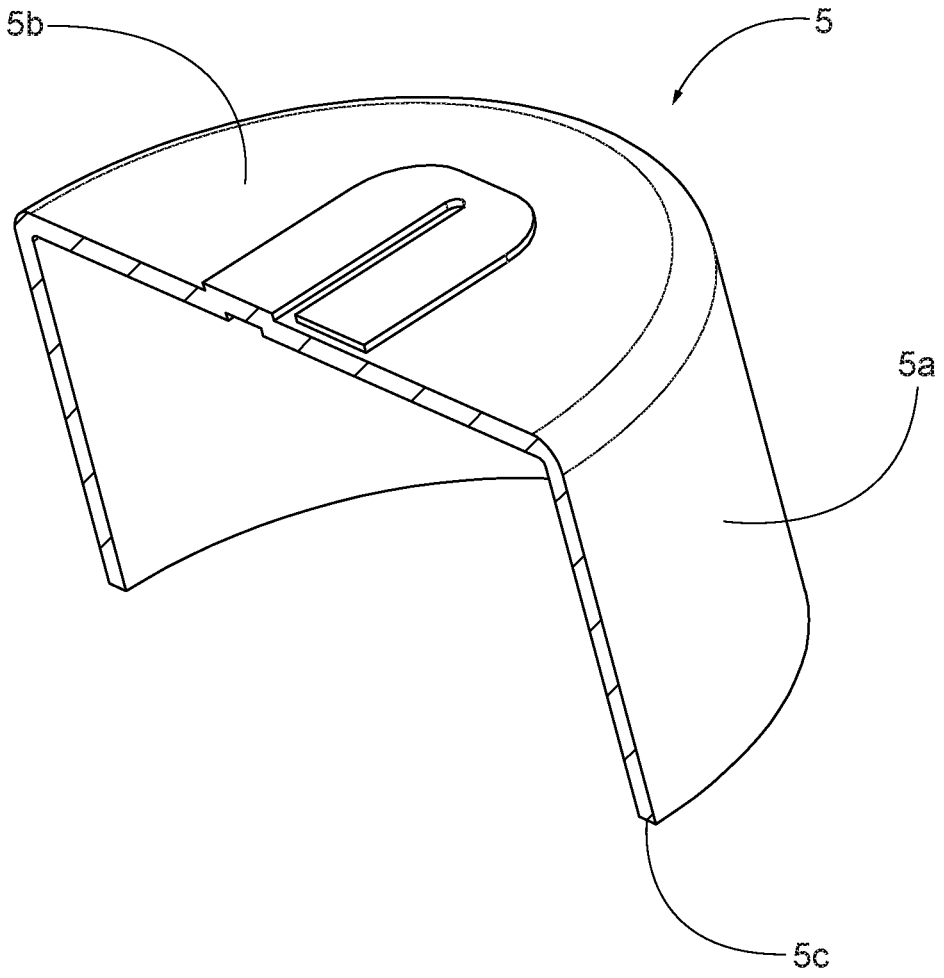
FIG. 10 is a cross sectional view of a cap insert.

The cap insert (5) is that part of the closure assembly (10) that a user presses to move the piercing means (4) downward within the threaded cap (3). Referring to FIGS. 4 and 10, the cap insert comprises a cylindrical wall (5*a*), a closed top (5*b*) and an opened bottom (5*c*). Preferably, the closed top sits higher than the threaded cap. The opened bottom of the cap insert is rigidly connected to the piercing means. For example, the opened bottom of the cap insert is sized to make a friction fit connection over the knee wall (4*g*) of the piercing means (4), such that the piercing means and cap insert are able to move as one with respect to the threaded cap (3). To further secure this connection any suitable means may be employed, such as adhesive, a snap-fit engagement or unitary molding. The cap insert and piercing means are able to translate downward within the threaded cap. The downward of the movement of the cap insert and piercing means occurs between an initial upper position and a final lower position (described above). Optionally, the outer surface of the cylindrical side wall (5*a*) of the cap insert may be provided with a circumferential groove (5*i*), such that the circumferential bead (3*i*) of the threaded cap may come to rest in this circumferential groove when the cap insert and piercing means reach their final lower position.

Figure 11:
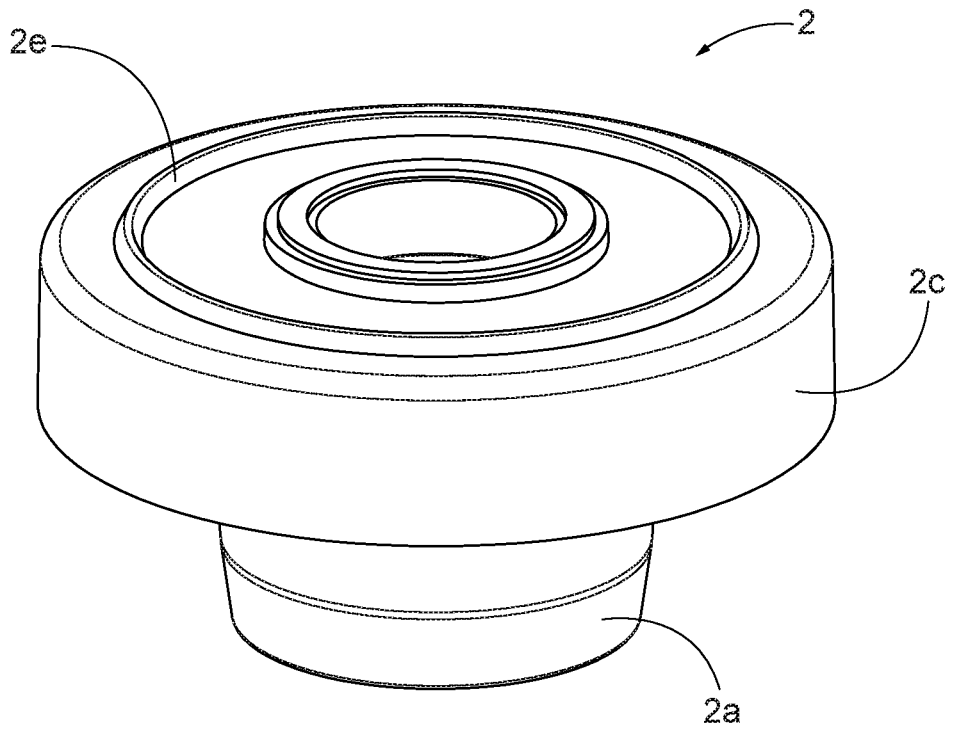
FIG. 11 is a perspective view of an orifice reducer.
Figure 12:
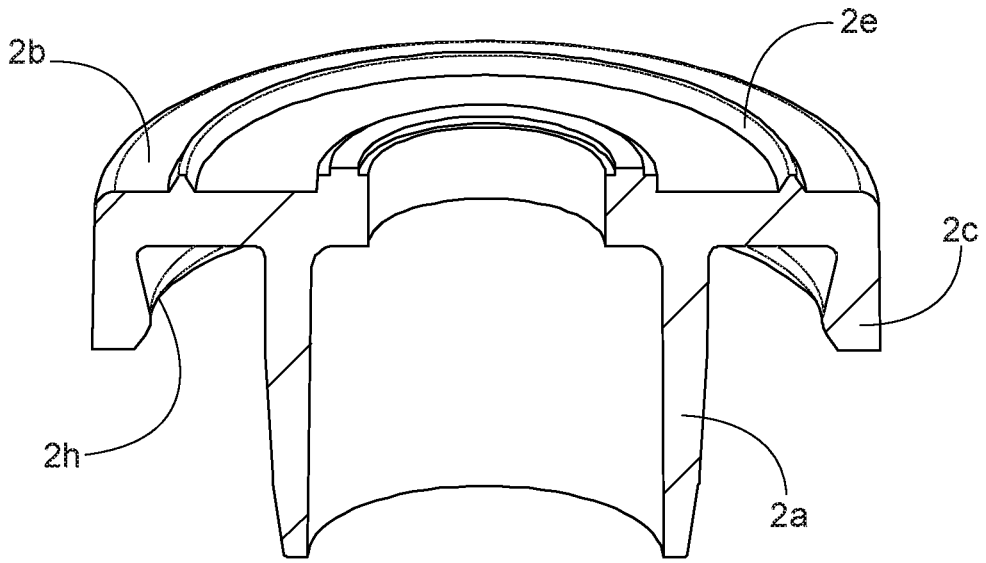
FIG. 12 is a cross sectional view of the orifice reducer of FIG. 11.

FIGS. 11 and 12 depict one embodiment of an orifice reducer (2). In general, the orifice reducer comprises a hollow cylindrical body (2*a*) that has a top a bottom. A flange (2*b*) surrounds the top of the body, extending radially outward from the body, and a skirt (2*c*) depends downwardly from the flange. The bottom of the skirt may be formed as an enlarged portion (2*h*) for gripping the neck (1*c*) of the container (1). Optionally, a sealing bead (2*e*) may rise from the flange of the orifice reducer, to make a secondary seal with the transverse partition (3*f*) of the threaded cap (3).

Figure 13:
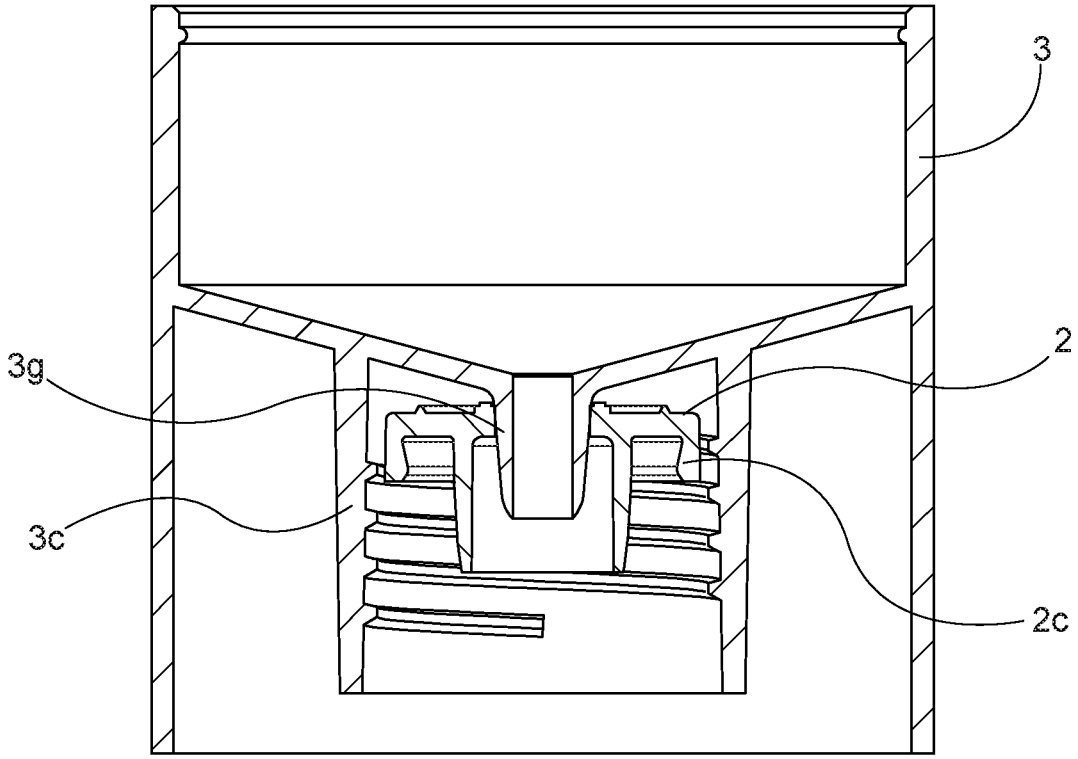
FIG. 13 shows the orifice reducer in relation to the threaded cap.
Figure 14:
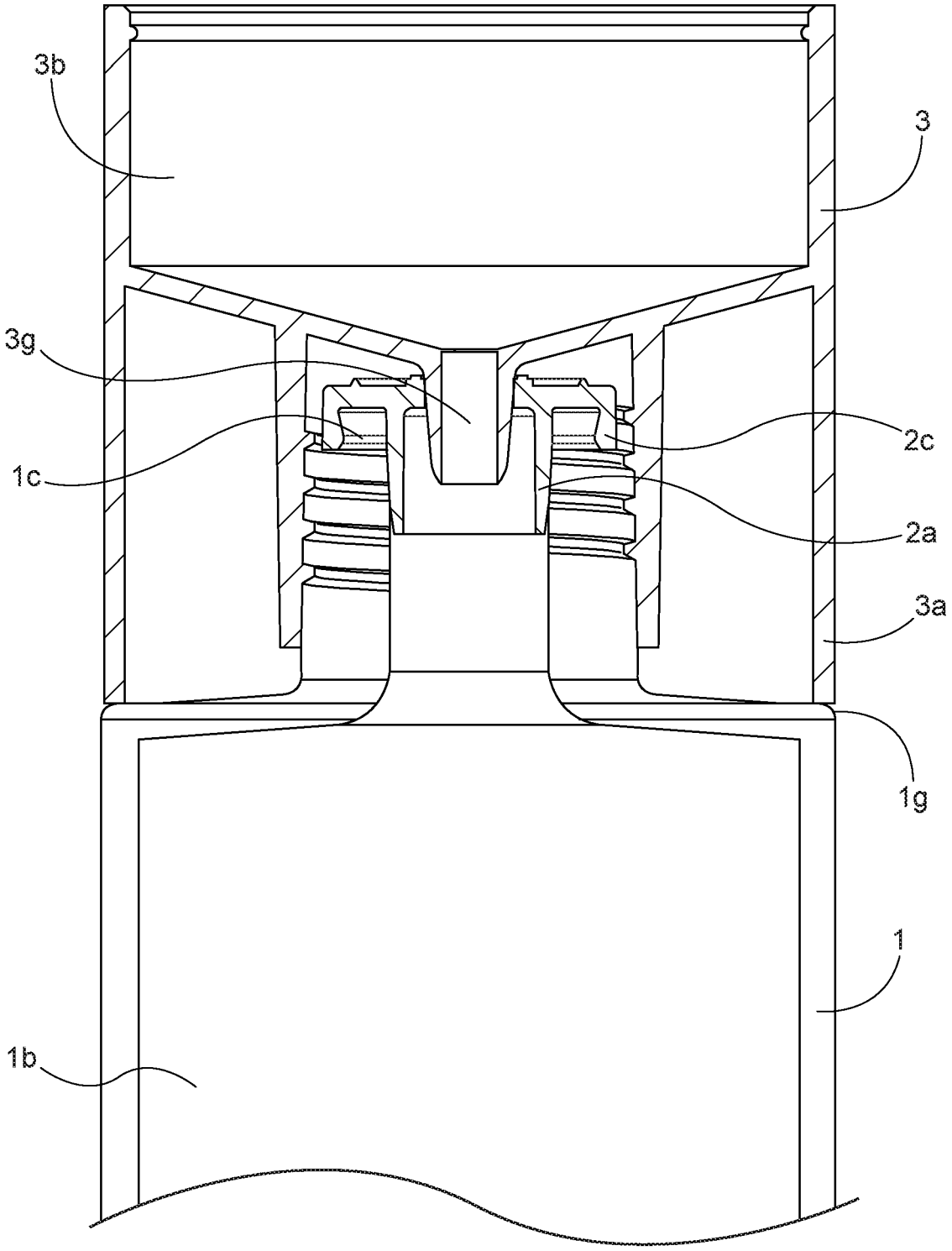
FIG. 14 shows the threaded cap and orifice reducer in relation to the container.

Referring to FIG. 13, the orifice reducer (2) is initially associated with the threaded cap (3). The orifice reducer is secured in the threaded cap, being friction fitted between the collar (3*c*) and the stem (3*g*). The first time that the threaded cap (3) with orifice reducer (2) is fully seated on the container (1), the skirt (2*c*) of the orifice reducer will be stretched over the neck (1*c*) of the container (as shown in FIG. 14). Thereafter, the orifice reducer will remain attached to the neck of the container, even when the threaded cap is unscrewed from the container. The attachment of the orifice reducer to the container may be facilitated by the enlarged portion (2*h*) of the skirt engaging the groove (1*h*) on the neck of the container. In the process, a liquid tight connection is formed between the orifice reducer and the neck of the container. In order to ensure a liquid tight connection between the orifice reducer and the neck of the container, the vertical wall (3*a*) of the threaded cap must not bottom out on the shoulder (1*g*) of the container before the orifice reducer is fully seated onto the neck.

As shown in FIG. 14, when the threaded cap (3) with orifice reducer (2) is fully seated on the container (1), then the hollow stem (3*g*) of the threaded cap and the cylindrical body (2*a*) of the orifice reducer are positioned in the neck (1*c*) of the container. The hollow stem and orifice reducer form a passageway between the first reservoir (1*b*) and second reservoir (3*b*), through which the first and second flowable products (P1, P2) can sometimes pass. However, when the cap insert (5) and piercing means (4) are at their lowest position with respect to the threaded cap (3), then the pintel (4*d*) of the piercing means extends into the hollow stem (3*g*) of the threaded cap (see FIG. 15). The pintel and hollow stem are sized to effect a liquid-tight seal that closes the passageway between the first and second reservoirs (1*b*, 3*b*).

Assembly and Filling

A threaded cap (3) of the type described herein is provided with a breakable seal over one or both ends of the hollow stem (3*g*). Next, an orifice reducer (2) is assembled into the threaded cap, as explained above. The upper section of the threaded cap (that is, the second reservoir, 3*b*) is filled with a quantity of a second flowable product (P2). The piercing means (4) is assembled into the top of the threaded cap by positioning the circumferential bead (3*i*) of the threaded cap in the circumferential groove (4*i*) of the piercing means. In this configuration, the piercing means is located at its upper position. Then the cap insert is attached to the piercing means, as described above. Alternatively, the cap insert may be attached to the piercing means first, and then the piercing means can be attached to the threaded cap. In this way, the second flowable product (P2) is trapped in the second reservoir (3*b*) of the threaded cap. The threaded cap with orifice reducer, piercing means and cap insert form a complete closure assembly (10) that is filled with the second flowable product (P2). The first reservoir (1*b*) of the container (1) is filled with a first flowable product (P1). This is done through the neck (1*c*) of the container, before the orifice reducer is attached to the neck. It is critical to leave enough headspace in the first reservoir for at least a portion of the second flowable product (P2).

Next, the closure assembly (10) is applied to the container (1) by screwing the threaded cap (3) onto the threaded neck (1*c*) of the container until tight. In the process, the skirt (2*c*) of the orifice reducer will be stretched over the neck (1*c*) of the container, and thereafter, the orifice reducer will remain attached to the neck of the container. At this point, the first flowable product is in the first reservoir (1*b*), and the second flowable product is in the second reservoir (3*b*), and the container-closure system appears as in FIG. 1. The container-closure system, which appears to be an ordinary bottle of product, is ready for distribution.

Consumer Use

Figure 15:
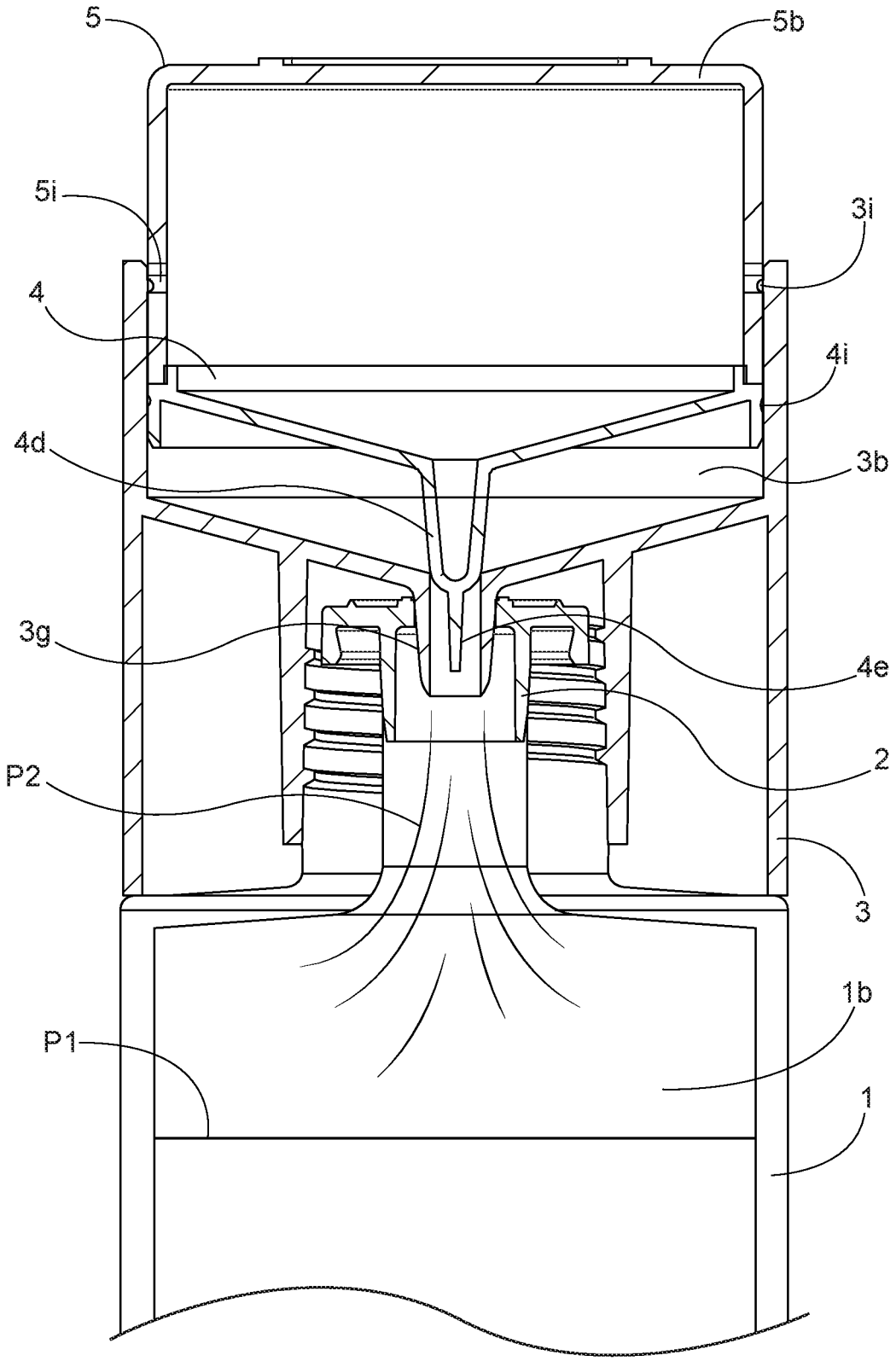
FIG. 15 shows a container-closure system according to the invention in use.

Referring to FIG. 15, when a user wants to use a fully assembled container-closure system of the present invention, the user applies pressure to the top (5*b*) of the cap insert (5) to force the circumferential groove (4*i*) of the piercing means (4) past the circumferential bead (3*i*) of the threaded cap (3). As the cap insert and piercing means travel downward within the threaded cap, the distal end (4*e*) of the pintel (4*d*) breaks the breakable seal (3*h*) of the hollow stem (3*g*), thus opening up the passageway between the first reservoir (1*b*) and second reservoir (3*b*). The second flowable product (P2) begins to fall into the first reservoir (1*b*) and mixes with the first flowable product (P1). The user continues to push down on the cap insert until it cannot be moved any further. By the time the piercing means has reached its final lower position, most or substantially all of the second product has fallen into the first reservoir, and the pintel is fully seated in the hollow stem where it effects a liquid-tight seal against the hollow stem, thus closing the passageway between the first and second reservoirs. Preferably, the fit of the pintel inside the hollow stem is sufficiently tight to prevent the pintel from accidentally backing out of the hollow stem. This will prevent the mixed products in the first reservoir from entering into the second reservoir. If the outer surface of the cylindrical side wall (5*a*) of the cap insert was provided with the optional circumferential groove (5*i*), then the circumferential bead (3*i*) of the threaded cap will come to rest in this circumferential groove when the cap insert and piercing means reach the end of their downward movement. This will further prevent the pintel from accidentally backing out of the hollow stem. Optionally, the consumer may shake the container-closure system to thoroughly mix the two products. Thereafter, a twisting force applied to the threaded cap (3) will unscrew the closure assembly (10) off of the container (1), but leave the orifice reducer (2) attached to the container. The consumer dispenses the mixed products by pouring through the orifice reducer. When finished, the closure assembly is again screwed onto the container like a conventional threaded closure.

What is claimed is:

1. A closure assembly for a container that defines a first reservoir that is able to house a first flowable product, the closure assembly comprising a threaded cap, a piercing means, a cap insert, and an orifice reducer, wherein:

the threaded cap comprises:

a vertical wall that defines an interior space that is divided into an upper section and a lower section by a transverse partition;

the upper section has an opened top that is able to receive the piercing means and cap insert, and functions as a second reservoir that is able to house a second flowable product;

a collar that depends from the transverse partition, down into the lower section and that comprises screw threads;

a hollow stem that depends from the transverse partition, and is located inside the collar; wherein the hollow stem is sealed with a breakable seal;

the piercing means comprises:

a cylindrical side wall that fits snugly into the upper section of the threaded cap, so as to allow the piercing means to slide therein between an initial upper position and a final lower position, while also forming a liquid tight seal between the cylindrical side wall and the vertical wall of the threaded cap;

a closed top;

an opened bottom, and a pintel that depends downward from the center of the closed top to a distal end;

the cap insert comprises a cylindrical wall, a closed top, and an opened bottom; wherein the opened bottom of the cap insert is rigidly connected to the piercing means;

the orifice reducer is secured between the collar and the stem of the threaded cap, and comprises a cylindrical body, a flange that extends radially outward from the cylindrical body, and a skirt that depends downward from the flange;

such that, when the piercing means travels from the initial upper position to the final lower position, the distal end of the pintel is able to break the breakable seal of the hollow stem, and then the pintel is able to enter into the hollow stem, and form a liquid-tight seal.

2. The closure system of claim 1, wherein a circumferential knee wall rises from the closed top of the piercing means, and the opened bottom of the cap insert makes a friction fit connection over the knee wall.

3. The closure system of claim 1, wherein:

the inner surface of the vertical wall of the threaded cap has a circumferential bead located above the transverse partition;

the outer surface of the cylindrical side wall of the piercing means has a circumferential groove; and wherein, the upper position of the piercing means is defined as the circumferential bead of the threaded cap being positioned in the circumferential groove of the piercing means.

4. The closure system of claim 1, wherein, when the piercing means has reached the final lower position, then the pintel is fully seated in the hollow stem.

5. A container-closure system that comprises:

a container that has a threaded neck and that defines a first reservoir that is able to house a first flowable product; and a closure assembly according to claim 1 that is applied to the container by screwing the threaded cap onto the threaded neck;

such that, when the threaded cap is fully seated on the container, then:

the skirt of the orifice reducer is stretched over the neck of the container to form a liquid tight connection between the orifice reducer and the neck of the container; and the hollow stem of the threaded cap and the cylindrical body of the orifice reducer are positioned in the neck of the container; and when the piercing means breaks the breakable seal of the hollow stem, a passageway is opened between the first and second reservoirs that allows the second flowable product to fall into the first reservoir; and when the pintel enters into the hollow stem, the passageway is closed.

6. The container-closure system of claim 5, wherein the piercing means is in the upper position relative to the threaded cap, and a first flowable product is housed in the first reservoir, and a second flowable product is housed in the second reservoir.

7. A method of filling the container-closure system of claim 5, comprising the steps of:

a. assembling the orifice reducer into the threaded cap;

b. filling the second reservoir with a second flowable product;

c. assembling the piercing means into the top of the threaded cap;

d. assembling cap insert onto the piercing means by a rigid connection, so that the piercing means and cap insert will move as one;

f. filling the first reservoir of the container with a first flowable product through the neck of the container, leaving enough headspace in the first reservoir for at least a portion of the second flowable product; and g. applying the closure assembly to the container by screwing the threaded cap onto the threaded neck of the container until tight.

8. A method of using the container-closure system of claim 5, comprising the steps of:

a. applying pressure to the top of the cap insert until the distal end of the pintel has broken the breakable seal of the hollow stem, and the pintel has entered into the hollow stem to form a liquid tight seal;

b. optionally, shaking the container-closure system to thoroughly mix the two products;

c. unscrewing the closure assembly off of the container;

d dispensing the mixed products by pouring through the orifice reducer; and e. screwing the closure assembly onto the container.

* * * * *